United States Patent [19]

Frankle et al.

[11] 4,099,584

[45] Jul. 11, 1978

[54] FLAME JET TOOL FOR DRILLING TO GREAT DEPTHS

[75] Inventors: Helmut Frankle; Werner Baum, both of Canoga Park, Calif.

[73] Assignee: Pei, Inc., Canoga Park, Calif.

[21] Appl. No.: 694,665

[22] Filed: Jun. 10, 1976

[51] Int. Cl.[2] ..... E21B 7/14

[52] U.S. Cl. ..... 175/14; 175/94; 175/308; 175/98

[58] Field of Search ..... 175/11-16, 175/93, 94, 97, 98, 99, 171, 230, 308, 309

[56] References Cited

U.S. PATENT DOCUMENTS

| | | | |
|---|---|---|---|
| 2,816,735 | 12/1957 | Dalinda et al. | 175/16 X |
| 3,045,766 | 7/1962 | Fleming, Jr. | 175/14 |
| 3,376,942 | 4/1968 | Van Winkle | 175/99 X |
| 3,620,313 | 11/1971 | Elmore et al. | 175/93 X |
| 3,792,741 | 2/1974 | Hopler, Jr. | 175/11 |
| 3,856,355 | 12/1974 | Grable | 175/308 |

*Primary Examiner*—Ernest R. Purser
*Assistant Examiner*—Richard E. Favreau
*Attorney, Agent, or Firm*—Spensley, Horn & Lubitz

[57] ABSTRACT

A flame jet tool for drilling a hole in the ground at great depths is disclosed. The tool comprises a flame jet lance having a drill bit and an associated fuel system. The lance is disposed in a guide sheath such that the lance may be raised and lowered therefrom. The tool may also include means for capturing debris. In operating the flame jet tool of the present invention, the guide sheath is lowered into a preexisting well hole a specific distance. The guide sheath is fixed to the sides of the hole and the flame jet lance is lowered from the guide sheath. At a predetermined point, the drill bit is ignited and caused to rotate thus increasing the depth of the hole. By the use of the flame jet tool of the present invention, holes of significant depth can be increased and materials of extraordinary hardness can be pierced.

27 Claims, 7 Drawing Figures

Fig. 2
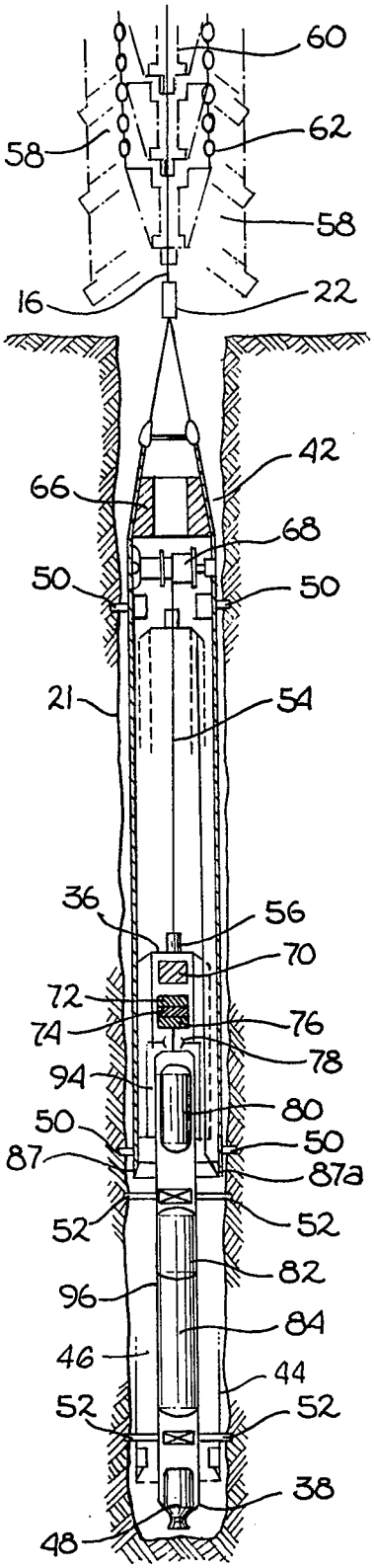
Fig. 3
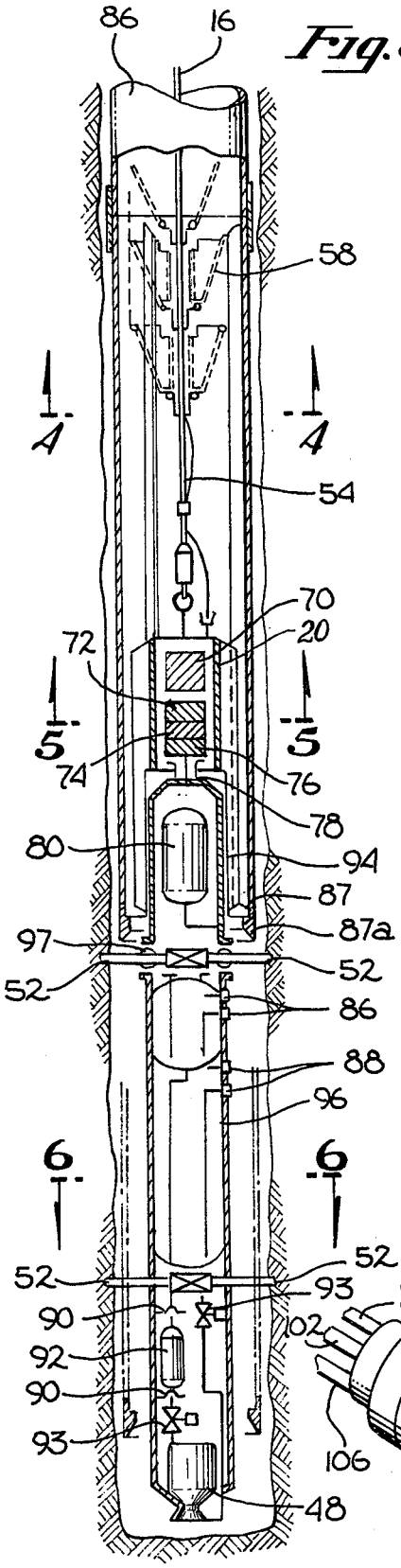
Fig. 4
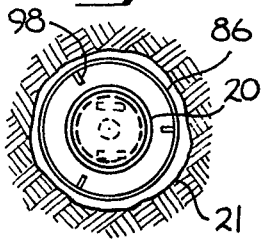
Fig. 5
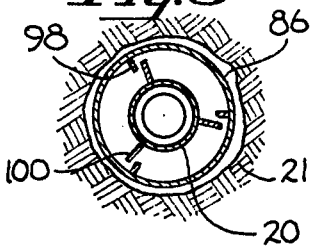
Fig. 6
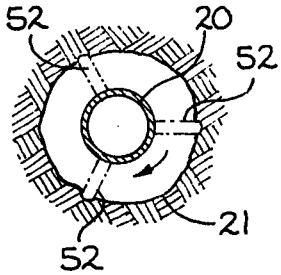
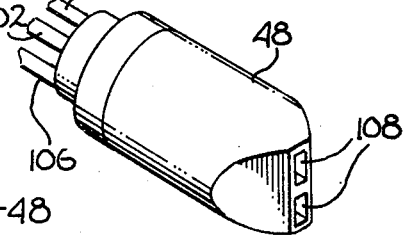
Fig. 7

FLAME JET TOOL FOR DRILLING TO GREAT DEPTHS

BACKGROUND OF THE INVENTION

1. FIELD OF THE INVENTION

The present invention relates to the field of drilling means, and more specifically, to a flame jet tool for drilling holes in the ground at great depths.

2. PRIOR ART

Excavation means, and more specifically excavation means utilizing a jet-type of instruments are well known in the art. One such type of system is disclosed by Ross, U.S. Pat. No. 3,152,651. In the Ross apparatus, an elongated member is lowered into the ground whereupon a steam jet nozzle is activated. Activation of the nozzle causes the steam to act upon the ground in such a manner that chunks of material are gorged out of the ground. The pressure from the steam jet nozzle also sends these chunks crashing about to further strike and break up the surface adjacent the jet nozzle. It should be noted, however, that such device, while perhaps useful for forming holes a relatively short distance, is not particularly adapted for drilling at great depth. Moreover, while such steam jet nozzle may be able to work under certain soil conditions, many types of hard solid rocks are not easily broken up by such a system.

Another type of device is disclosed by Fleming, U.S. Pat. No. 3,045,766. In the Fleming device a blow pipe is lowered into the earth which contains a rotating burner adjacent the bottom thereof. Fuel and oxygen are supplied to the burner and the flames emitting therefrom are used to melt holes in the ground. While such a system has proved to be useful in a wide range of different rocks and soil, there is no means indicated that would enable such a device to be used when drilling at substantial depths.

Yet another type of device is disclosed by Elmore, U.S. Pat. No. 3,620,313. In the Elmore device a liquid propellant is burned and is pulsed to produce high combustion pressure with large power outputs. The device comprises an upper part and a lower part. The upper and lower parts are connected through a gimble mount to permit articulation of the lower part with respect to the upper part. While such device is disclosed as being adaptable for drilling at great depths, there is no disclosure of means for controlling the articulation of the lower part or for raising or lowering the lower part so as to further increase the controllability thereof.

The problems of drilling at great depths are recognized in the art. For example, pressure systems which could be used for drilling near the surface of the earth present major problems when the same type system is used to drill at great depths, i.e., depths exceeding 100 meters. This depth in the earth surface produces problems in the ability to pump fluids from the surface to the drill bit. While many such systems have been evolved to enable this pumping to take place, uneven burning due to uneven amounts of fuel being supplied to the drill bit has resulted. Recently, self-contained drilling members have been used. Such self-contained members are usually lowered into the ground by a cable. However, even with these new systems, when depths of greater than 100 meters are encountered, it is difficult to control the action of the drill bit especially when such bit is suspended from a cable which in turn must also be at least 100 meters in length. The prior art devices, including those discussed hereinabove, all use a variety of suspension cables to lower the drill bit into the well hole so as to enable the bit to cut through the ground and thereby extend to the crust of the earth. While such systems may work in certain type of rocks and for relatively shallow holes, the present invention represents improvements in the ease with which such holes are extended to great depth such as, for example, 10,000 meters, as well as the simplicity of operation.

Yet another problem associated with such prior art devices is the fact that in forming holes in particularly hard materials, the need to rotate the drill bit as well as to carry the material which has been blasted out of the hole away from the area has been found to be necessary. The above prior art devices discuss no means to accomplish this. By the use of the device of the present invention, such shortcomings are overcome and an effective solution is thus presented. This is achieved by coupling debris containers to the lance-and-guide shaft combination. Such debris containers prevent the substantial downward movement of loose particles.

While the present invention is particularly useful in extending oil well holes, it can also be used to form holes in exceedingly hard materials such that blasting material may be placed down into such holes so as to loosen the earth and thereby rendering it substantially more removable. Thus, the present invention finds utility in the oil well field as well as in the mining field.

BRIEF SUMMARY OF THE INVENTION

The present invention relates to novel means for forming holes in the earth, and more specifically, to a flame jet tool comprised of a flame jet lance circumferentially disposed in an associated guide sheath. The tool is adapted for drilling in the ground at great depths and comprises the elongated flame jet lance having a drill bit and an associated fuel system. The lance comprises first and second interconnected sections with the drill bit disposed adjacent the end of the first section, and means for activating and controlling the drill bit disposed in the second section. A guide sheath is disposed about the lance and is coupled to the lance by a suspension means such that the lance can be selectively raised and lowered. A cable is affixed to the sheath and is used to lower the sheath and lance into the ground. Alternatively, a plurality of debris containers may be coupled to the cable such that when the drill bit is activated, the upward folded containers would permit particles and the like to travel upward to the hole exit when the drill bit is ignited and creates an upward gas flow. When the gas flow ends, the containers unfold trapping the debris on several levels from falling back to the bottom of the hole. In this manner, loose debris adjacent the drill bit is prevented from falling back upon the drilling area thus increasing the rate at which the drill bit proceeds through the earth. The folding of the containers is achieved automatically and is caused by ceasing of the powerful gas flow from the drill bit. The containers are then emptied when the lance is lifted to the surface.

In operating the drill bit of the present invention, the drill bit can be used to initially form a hole in the ground or can be used to extend a preexisting hole. In a first situation, the drill bit is lowered into a hole a predetermined distance at which time the guide sheath is fixed to the sides of the hole. The elongated flame jet lance is lowered by the suspension means and is caused to rotate as the drill bit is ignited. An extremely intense flame jet extends out of the drill bit and impinges upon the bottom of the hole so as to cause melting and spalling of rock adjacent thereto. Because the force of the flame jet is so great, particles of rock and the like are forced up the entire length of hole to the top thereof. However, other particles may not make it to the top and will then fall back down upon the area being drilled. To prevent such material from interfering with the drill bit action, a unique system of debris containers is disposed on the cable such that the particles enter into these containers. When the lance is spent, it is raised to the surface where such containers are then emptied. Because the lance is comprised of first and second interconnected sections, the second section which contains the fuel and oxidizer tanks is removable and thus can be replaced with a refueled second section whereby the process is then repeated. In this manner a hole may be drilled or extended into the earth surface a substantial distance without the problems associated with the prior art.

In a second situation, a well sheath has already been disposed in the ground adjacent the bottom of the hole. In this case there is no need for the guide sheath as the well casing takes its place. The lance is lowered via a cable suspension system through the well sheath. Such well sheath is provided with means for engaging the lance so as to prevent undesirable rotation. The same operating procedures as discussed hereinabove are repeated. However, in this embodiment, the lance may also contain outward-extending positioning members which can be used to engage the well sheath. Raising the lance with the positioning members extended causes the well sheath to also travel upward. In this manner, the sides of the well hole are rendered smooth.

The novel features which are believed to be characteristic of the invention, both as to its organization and method of operation, together with further objectives and advantages thereof, will be better understood from the following description considered in connection with the accompanying drawings in which the presently preferred embodiment of the invention is illustrated by way of example. It is to be expressly understood, however, that the drawings are for the purpose of illustration and description only, and are not intended as a definition of the limit of the invention.

BRIEF DESCRIPTION OF THE DRAWINGS

FIG. 2 is a cut-away view showing the interior of the flame jet tool, and more specifically, the guide sheath and the flame jet lance as well as the debris containers.

FIG. 3 is an enlarged cut-away view showing the lance being lowered in a well sheath.

FIG. 4 is a cross-sectional view of FIG. 3 taken along lines 4—4 and showing the well sheath and the positioning members extending radially inward.

FIG. 5 is a cross-sectional view of FIG. 3 taken along lines 5—5 and showing the engagement of members of the guide sheath by the holding members on the lance.

FIG. 6 is a cross-sectional view of FIG. 3 taken along lines 6—6 and showing the positioning members radially extending outwardly from the lance.

FIG. 7 is a cut-away perspective view showing the drill bit used in the present invention.

DETAILED DESCRIPTION OF THE INVENTION

Figure 1:
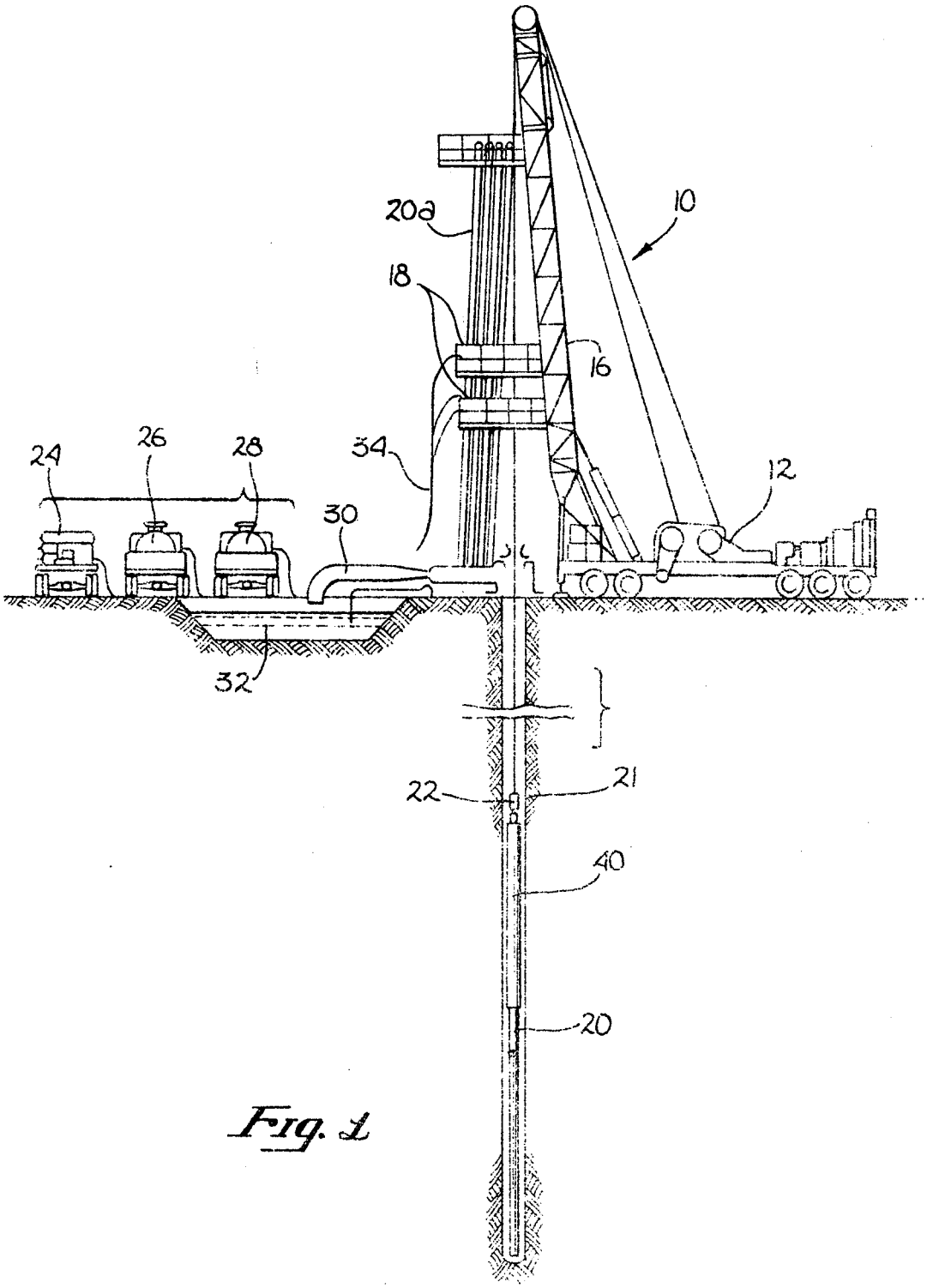
FIG. 1 is a schematic view showing the flame jet tool being lowered from a mobile rotary drill rig.

Referring first to FIG. 1, there is shown a mobile rig 10 which is used for raising and lowering the lance 20 and associated guide sheath 40 of the present invention. The mobile rotary drill rig 10 is comprised of a truck 12 having a boom 16 affixed at one end thereof and an associated cable system 14. Such mobile truck, boom and cable systems are well known in the art and will not be discussed in detail herein. Of course, it is to be understood that the stationary type drilling rigs are also within the scope of this invention.

At one end of cable system 14 is the associated guide sheath 40 securely coupled to the cable 14 via coupling member 22. A platform 18 is also coupled to the boom 16 and extends outwardly therefrom which platform supports a plurality of additional lances **20*a*. Such additional lances 20*a* are easily mounted in the guide sheath 40 when the original lance 20, and more specifically, the fuel tanks, are expended. In one embodiment of the present invention, additional lances 20a which are self-contained units, are lowered by cable 14 into a preexisting well hole 21. In another embodiment of the present invention, a series of fuel supply means are disposed on the surface of the ground with associated connecting pipes which proceed down into the ground thus enabling the lance to be used for extended periods of time. Shown in FIG. 1 is a compressed gas truck 24, a diesel oil tank truck 26, and a nitric acid tank truck 28. The tank trucks can be coupled directly to the lance so as to increase the time such lance can be used. Such tank trucks can also be coupled to the additional lances 20*a* by means of flexible tubing 34. In this manner, a spent lance may be refueled on platform 18** thus decreasing the turn-over time for switching a spent lance for a new refueled one.

A water ejector exhaust system 30 having a pumping means is also coupled to the well hole 21 and empties into a water basin 32. Such water ejector system is used to flush out the debris blowing up from the gas jet and to precipitate toxic parts of the exhaust gases.

Referring now to FIG. 2, a cut-away view of the guide sheath 40 and lance 20 is shown in a typical well hole 21. While such a sheath-and-lance system can be used to form the initial hole in the ground, the present system is particularly adapted for a preexisting hole in order to extend the hole. It is also adapted should drilling proceed to a point where a particularly hard material is encountered in order to pierce such material. As indicated in this Figure, the guide sheath 40 is a generally elongated tube-like structure having a first end 42 and a second end 44. Cable 16 is coupled to the first end 42 of the sheath 40 by coupling member 22. The guide sheath 40 is circumferentially disposed about the lance 20 and, as indicated in phantom lines, the lance 20 is movable from a first retracted position, to a second extended position wherein the lance extends out of end 44 of the sheath 40.

Disposed within lance 20 is a fuel system referred to generally by the numeral 46 which is coupled to a drill bit 48 disposed in bottom end 38 of the lance 20. In the presently preferred embodiment, a suspension member 54, which is a steel cable, is coupled to the lance 20 adjacent top end 36 by coupling 56 such that the lance 20 is suspended from a pulley system 68 in the guide sheath 40.

Located above the guide sheath 40 on the cable 16 are a series of interconnected cone-shaped debris containers 58. These containers 58 are coupled to the cable 16 via hinges 60 at one end thereof and also linked together via link member 62 adjacent the other end thereof. The action of the containers is to pick up debris which tend to fall back in the hole 21 caused by the stop of the exhaust gases at end of burning as hereinafter discussed. Controls 66 for activating the pulley 68 are disposed in the sheath 40 adjacent the end 42 thereof. These controls are usually electronic controls and include a battery thus enabling the operation of pulley 68 to take place without the need for controls to extend to the surface. Because such electronic controls 66 are well known in the art, they will not be discussed in detail herein. Of course, if desired, such controls can be linked through a cable to the surface and thus the entire operation of the sheath and/or lance can be controlled from the surface of the ground. The guide sheath 40 also includes positioning members 50 at each end thereof. The members 50 prevent undesirable movement of sheath 40 during the drilling operation.

Disposed within the lance 20 adjacent end 36 thereof is a sequencer 70, a battery 72, a hydraulic motor 74, a slew driving mechanism 76, and a rotatable bearing member 78. The sequencer 70 is adapted to activate as well as control various operating functions of the lance 20 including, but not limited to, initiating the action of the drill bit and controlling the rotation of the lance. Moreover, the rate of the progress of the lance through the ground is transmitted back to the sequencer 70 and such information in turn can be transmitted back to controls 66 thus regulating the rate at which the lance 20 is lowered. In the preferred embodiment, a hydraulic motor 74 is used to power a slew driving mechanism so as to render the lance 20 rotatable. In the preferred embodiment, lance 20 is comprised of a first section 94 and a second section 96. Such first and second sections are joined by bearing member 78 such that the second section 96 is rendered rotatable as hereinafter described. A nitrogen gas tank 80 is disposed in the lance 20 and is used as the pressure means by which to force the various reactant through the lance 20 to the drill bit 48. Of course, other inert gases can also be used or, in other embodiment, the tank 80 can be replaced with a pumping mechanism to drive the fuels to the bit 48. A fuel tank 82 and an oxidizer tank 84 are coupled to the nitrogen tank 80 such that the pressure from the tank 80 is used to move the fuel and oxidizer to the drill bit 48.

Referring now to FIG. 3, an enlarged view of the lance 20 is shown. While such Figure shows an enlarged view of the lance 20, it also indicates that the debris containers can be disposed directly above the lance 20 rather than above the guide sheath 40. In this embodiment of the present invention, the lance 20 has been lowered through a well sheath 86. In such a configuration, there is no need for a guide sheath to provide the necessary guidance and support for the lance 20. Well sheath 86 has associated inwardly-extending members 98 to prevent undesirable rotation of the lance 20 as hereinafter described.

As indicated in FIG. 3, the lance 20 is comprised of a first rotatable section 96 and a second section 94. Such first and second sections are joined together via coupling elements 97 such as plate and bolt members. In this manner, the first section 96 which contains the oxidizer and fuel tanks as well as the drill bit 48 can be removed from the lance and replaced without the need for having a second lance containing sequencer 70, battery 72 and the like. In the presently preferred embodiment, diesel oil is stored in the tank 82 and is used as the fuel and nitric acid is used as the oxidizer and stored in the oxidizer tank 82. The driving means used to force the fuels and oxidizer to the drill bit 48 is nitrogen stored in the first section 94 in tank 80. Various coupling valves 88 extend out of the lance 20 and enable the various tanks to be filled from exterior sources. A furfuryl alcohol tank 92 is located between two burst membranes 90 such that it is separated from the fuel system as the furfuryl alcohol is used to initiate the reaction between the fuel and the oxidizer. In the presently preferred embodiment, a non-hypergolic fuel system is used thus requiring the necessity of the furfuryl initiator. Of course, if hypergolic fuel is used, then there will be no need for such an initiator and the associated initiator tank. Valves 93 disposed in the fuel and oxidizer lines control the rate at which the fuel and oxidizer flow to the drill bit 48. Finally, various positioning members 52, which have an extended and retracted position, are disposed on the lance 20. In an extended position, these members 52 engage the sides of the wall of the hole 21 thus preventing undesirable rotation. Referring again to FIG. 2, similar positioning members 50 are also disposed on the guide sheath 40 so as to prevent undesirable rotation of the guide sheath 40.

Referring now to cross-sectional views 4, 5 and 6, one can see the various related positions of the lance 20 and the well sheath 86. Indicated in FIGS. 4 and 5 is the fact that the lance 20 has stop members 100 extending outwardly therefrom which engage protrusions 98 so as to prevent undesirable rotation or movement of the lance 20 within the well sheath 86.

Referring now to FIG. 7, a typical drill bit 48 is shown. Such drill bit has a nozzle 108 and associated reaction chamber which is of a specific configuration as set forth and described in U.S. Pat. No. 3,169,368, herein incorporated by reference. Various flexible tubing lines 104 and 106 extend from the fuel and oxidizer tank into the reaction chamber within the drill bit 48 and power lines 102, if necessary, are also extended to the drill bit 48.

In operating the tool of the present invention, it should be remembered that conventional cable drilling machines currently form holes to the depth of approximately 2,000 meters. Because the flame jet lance 20 of the present invention is completely self-contained and is used in combination with a guide sheath 40 or well casing 86, these depths can easily be surpassed. Moreover, the removal of debris which plagued the prior art and interfered with drilling is substantially eliminated by a combustion of (1) the gases expended from the drill bit 48 which has an estimated velocity of 100 meters per second and creates considerable flushing force, and (2) because any debris which remains within the hole 21 is captured by the cone-shaped containers 20 as it proceeds downward in the hole 21.

The flame jet lance 20 can be initially fueled on the drill rig 10 from an external source via valve coupling system 88. This system also enables a spent lance to be easily refueled without any lengthy delays. Refueling is done from the associated tank trucks, each mounted with a refueling unit through the leakproof, quick filling valves 88.

The lance 20, and more specifically, the drill bit 48, is ignited by activating the pressure system powered by nitrogen tank 80 which in turn opens the engine valves. This action is initiated by the sequencer 70. The propellants are driven to the compression chamber in the drill bit 48 by the pressurized gas (nitrogen is the preferred pressurized gas, but other gases or a pumping system are of course within the scope of this invention). As the pressure builds up, burst membranes 90 are broken and the initiator as well as the fuel are caused to flow in one direction only which is into the reaction chamber in the drill bit 48. Upon mixing with the fuel and oxidizer, the furfuryl causes such reactance to ignite thereby producing the associated flame jet. Upon mixing with the fuel and oxidizer, for example, the furfuryl alcohol causes such reactants to ignite thereby producing the associated flame jet. The following represents typical flame drilling performance characteristics for opening of geothermal sources:

The following represents typical flame drilling performance characteristics:

| | | | |
|---|---|---|---|
| Thermal output per second | | | 5560 kJ/s |
| Mechanical output of the exhaust stream on jet nozzle | | | 515 kJ/s |
| Mechanical output in rock ca. | | | 1400 kJ/s |
| Mixture ratio $= \frac{\dot{m}\ HNO_3}{\dot{m}\ \text{diesel oil}} = 5.54$ | | | |
| Specific propellant consumption (granite) | $m_g$ | = | 2.38 g/cm$^3$ |
| Propellant consumption | $\dot{m}$ | = | 0.950 kg/s |
| Propellant volumes | $V_p$ | = | 0.17 l/s |
| | $V_g$ | = | 0.69 l/s |
| | $V_{ox}$ | = | 0.52 l/s |
| Lance burning time | t | = | 6–30 minutes depending upon amount of fuel and rate of consumption |

| | |
|---|---|
| sandstone | 92 m/hr |
| granite | 21 m/hr |
| basalt | 18 m/hr |
| bore diameter | variable |

To operate the flame jet lance 20 and associated guide sheath 40, the fuel system 46 within the lance 20 is provided with the necessary oxidizers, fuels, and initiator, if necessary. The sheath 40 and lance 20 are coupled together with the lance 20 within the guide sheath 40. The guide sheath 40 is then lowered via cable 16 into preexisting well hole 21. When a desired distance is reached, the cable 16 stops and the guide sheath 40 is positioned against the sides of the well hole by activating the positioning members 50. In one embodiment, the lance 20 may include flange sections 87 which engage flange ledges 87*a* on the guide sheath 40. Such flange sections 87 and ledges 87*a* stop the downward travel of the lance 20 such that only the removable lower section 96 extends out of the bottom 44 of the guide sheath 40. Members 87 and 87*a* control the drill bit 48 and the lance 20 and prevent undesirable movement thus increasing the life of the lance and the efficiency of the bit 48. Members 50 then extend outward and grasp the sides of the well hole 21 such that the sheath 40 is rendered substantially immovable. At this point, the control system 66 in the sheath 40 signals the sequencer 70 in the lance 20. The sequencer 70 initiates the action of the hydraulic motors 74 and the associated slew drive 76 which begins axial rotation so as to cause the lower section 96 of the lance 20 to rotate. The sequencer 70 also activates the various fuel feed systems which in turn cause the various fuel and oxidizers to be pumped from their respective tanks to the drill bit 48. Reaction in the drill bit is initiated and the associated flame jet and high velocity gases begin to spew out of the nozzle 108. As the flame jet impinges upon the ground adjacent thereto, the rate of progress of the drill bit through the ground is monitored by both the sequencer 70 and the associated control 66 in the guide sheath 40. In this manner, the pulley 68 is controlled so as to lower the lance 20 on suspension members at a predetermined rate.

As the drill bit 48 works its way through the earth, particles of rock are caused to be forced up the entire length of the hole 21 and fly out the top thereof. This action is due to the tremendous pressure created by the flame jet gases of the drill bit 48. To encourage such particles out of the hole 21 and to prevent the jet gases from exiting into the atmosphere, an ejector system 30 pumps the particles and gases into water trough 32. Such ejector systems are well known in the art. However, some rocks and other debris may not make it all the way to the top and will return back down to the area adjacent to the drill bit 48 when the bit is extinquished or before. This can interfere with the drill bit action. The cone-shaped containers 58 are disposed on the cable 16 above the guide sheath 40 to alleviate this problem. Such containers 58 can be controlled either by the controls 66, by controls exterior to the hole 21 or by pressure controls which would cause the containers to open when the drill bit no longer thrusts out the high velocity gases. In any event, the cone-shaped containers are positioned such that they substantially prevent the downward travel of any rocks or debris which then become entrapped in such containers. When the drill bit 48 is extinguished, it is raised back up into the guide sheath 40 via pulley 68. If the cone-shaped containers 58 have been extended radially outward, they are closed so as to prevent any of the debris from falling back down to the bottom of the hole 21. The entire guide sheath 40 and lance 20 are then raised to the surface where the cone-shaped containers 58 are completely open so as to enable the debris to exit therefrom. Inasmuch as the lower section 96 of the lance 20 is removable from the upper section 94, such lower section 96 is then removed and another fully charged section is coupled to the remainder of the lance 20. The above-described procedure is then repeated until the desired depth of the hole is achieved. Of course, if only one lance is provided, exterior couplings 88 can be used to recharge the lance 20.

In the second embodiment of the present invention, the lance 20 is lowered down in a prepositioned well sheath or casing 86. In this embodiment, debris containers 58 are disposed directly above the lance 20 on cable 16. In the second embodiment there is no need for an exterior guide and positioning sheath 40 inasmuch as the well sheath 86 acts as such guide and positioning member. Referring specifically to FIGS. 4, 5 and 6, the cross-sectional views indicate that internal positioning members 98, which prevent such undesirable rotation of the lance, are provided on the well sheath 86. Such members can also be adapted to guide the lance 20 through the well sheath 86. FIG. 5 indicates engagement of members 98 by member 100 of the lance 20 and in this position, the top section 94 of the lance 20 is rendered immovable. Such members 100 can also be used, if necessary, in guide sheath 40. Finally, well sheath 86 can also have ledge members 87*a* to prevent the entire lance 20 from extending out of the well sheath 86. Such ledge members 87*a* engage flange members 87 on the lance 20 such that only section 96 extends out of the well sheath 86.

The same action of the drill bit 48 is initiated as described hereinabove, i.e., the lower section 96 is rotated via slew drive mechanism 76 and associated bearing member 28, which in turn causes the rotation of the drill bit 48. In the second embodiment of the present invention, the outward extending positioning means 52 on the lance 20 can also be used for another purpose. For example, after the rotation of section 96 is completed and the various reactants expended, the positioning means 52 can be extended and the lance 20 raised to the surface. As the lance 20 is being raised, the positioning means 52 engage the bottom of the well sheath 86. In this manner, the well sheath is also caused to be raised to the surface, and as the well sheath engages the sides of the hole 21, the hole is rendered substantially smooth. Moreover, to increase this smoothing action, the exterior of the well sheath can be equipped with various protruding members which increase the smoothing action of the well sheath 86.

In this manner, holes are drilled to extremely great depths of 2,000 to 5,000 meters and even greater, and through materials of substantial hardness. Although this invention has been disclosed and described with reference to a particular embodiment, the principles involved are susceptible of other applications which will be apparent to persons skilled in the art. For example, various fuels and reactants can be used as well as various means for raising and lowering the lance, such as, for example, a rack and pinion type system could be used as the means for such raising and lowering action. Moreover, various other guide members can be used to guide the lance down to the bottom of the hole 21. Finally, a plurality of sets of debris containers 58 can be disposed at various positions along the length of cable 16 or suspension member 54. This invention, therefore, is not intended to be limited to the particular embodiments herein disclosed.

We claim:

1. A flame jet tool for drilling a hole in the ground at great depths comprising:

(a) a flame jet lance having a drill bit and an associated self-contained fuel system disposed in said lance, said fuel system including at least one fuel tank coupled to said drill bit such that fuel is caused to travel from said tank to said drill bit;

(b) a sheath circumferentially disposed about said lance, said lance being configured in said sheath such that said lance is slidably extendable therefrom; and (c) positioning means on said lance and said sheath for preventing undesirable movement in said ground.

2. The flame jet tool of claim 1 wherein said lance includes rotation means for rotating said drill bit.

3. The flame jet tool of claim 1 wherein said sheath is suspended from hanging means.

4. The flame jet tool of claim 3 wherein said sheath includes means for raising and lowering said lance.

5. The flame jet tool for claim 1 wherein said fuel system comprises a series of interconnected tanks, said tanks being coupled to said drill bit such that fuel is caused to travel from said tanks to said drill bit.

6. The flame jet tool of claim 5 wherein said lance comprises first and second sections with said drill bit disposed in said first section, said first and second sections interconnected whereby said first section is rotatable with respect to said second section.

7. The flame jet tool of claim 6 wherein said fuel system includes at least one fuel tank and at least one oxidizer tank, said fuel and oxidizer tank being located in said first section of said lance.

8. The flame jet tool of claim 6 wherein means for pumping fuel to said drill bit is disposed in said second section of said lance.

9. The flame jet tool of claim 6 wherein said first section is removably coupled to said second section.

10. The flame jet tool of claim 9 wherein said sheath and said lance each have positioning means for selectively engaging the walls of said hole so as to render said sheath and said lance substantially immovable.

11. The flame jet tool of claim 10 wherein said lance further includes means for activating and controlling said drill bit, said means disposed in said second section.

12. The flame jet tool of claim 11 wherein said sheath is coupled to said lance by a suspension means such that said lance can be selectively raised and lowered.

13. The flame jet tool of claim 12 wherein said sheath has power means for selectively activating said suspension means.

14. The flame jet tool of claim 13 wherein said suspension means is a cable system coupled at one end thereof to said lance and at the other end thereof to said sheath.

15. A flame jet tool for drilling at great depths and adapted to be raised and lowered from a hole in the ground by a cable comprising:

(a) flame jet lance having a drill bit and an associated fuel system, said drill bit producing high velocity gases and flames in said hole adjacent the bottom thereof;

(b) a guide sheath selectively coupled to said lance such that said lance is removable therefrom, said sheath having suspension means for raising and lowering said lance; and (c) a plurality of debris containers coupled to said cable such that when said lance is extinguished, said containers prevent particles of rock and the like from falling back down said hole to the bottom thereof.

16. The flame jet tool of claim 15 wherein said debris containers are rotatably mounted on said cable such that when said tool is raised to the surface, said particles may be removed from said containers.

17. The flame jet tool of claim 15 wherein said fuel system comprises a series of interconnected tanks, said tanks being coupled to said drill bit such that fuel is caused to travel from said tanks to said drill bit.

18. The flame jet tool of claim 15 wherein said sheath and said lance each have positioning means for selectively engaging the walls of said hole so as to render said sheath and said lance substantially immovable.

19. The flame jet tool of claim 15 wherein said lance is rotatably coupled to said guide sheath.

20. A flame jet tool for drilling in the ground at great depths and adapted to be raised and lowered from a hole in the ground by a cable comprising:

(a) an elongated flame jet lance having a drill bit and an associated fuel system, said lance comprising first and second interconnected sections with said drill bit disposed in said second section, and means for activating and controlling said drill bit disposed in said first section;

(b) a guide sheath circumferentially disposed about said lance and coupled to said lance by suspension means such that said lance can be selectively raised and lowered; and (c) a plurality of debris containers coupled to said cable such that when said drill bit is deactivated, particles and the like are prevented from falling back down said hole and are caused to enter into said containers where they are entrapped.

21. The flame jet tool of claim 20 wherein said fuel system includes at least one fuel tank and at least one oxidizer tank, said fuel and oxidizer tanks being located in said second section of said lance.

22. The flame jet tool of claim 20 wherein means for pumping fuel to said drill bit is disposed in said first section of said lance.

23. The flame jet tool of claim 20 wherein said lance is rotatable in said sheath such that upon activation of said drill bit, said lance is caused to rotate thereby rotating said drill bit.

24. The flame jet tool of claim 20 wherein said debris containers have a cone-like shape and are movable from a first retracted position to an extended position, when in said retracted position, said containers fit within said sheath, and when said lance is extinguished, said containers are moved into said extended position so as to engage the sides of said hole.

25. The flame jet tool of claim 20 wherein said guide sheath has power means for selectively activating said suspension means.

26. The flame jet tool of claim 25 wherein said suspension means is a cable system coupled at one end thereof to said lance and at the other end thereof to said guide sheath.

27. A flame jet tool for drilling a hole in the ground at great depths comprising:

(a) a flame jet lance having a drill bit and an associated fuel system;

(b) a sheath circumferentially disposed about said lance and suspended from hanging means, said lance being configured in said sheath such that said lance is slideably extendable therefrom;

(c) positioning means on said lance and said sheath for preventing undesirable movement in said ground; and (d) a plurality of debris containers coupled to said hanging means adjacent said sheath such that as debris and the like is removed from said hole, said debris becomes entrapped in said debris containers.

* * * * *